US007549641B2

(12) United States Patent
Darling

(10) Patent No.: US 7,549,641 B2
(45) Date of Patent: Jun. 23, 2009

(54) METHOD AND DEVICE FOR PLAYING A GAME USING A GRID

(76) Inventor: Richard Darling, 138 S. Zurich Ave., Egg Harbor City, NJ (US) 08215

( * ) Notice: Subject to any disclaimer, the term of this patent is extended or adjusted under 35 U.S.C. 154(b) by 202 days.

(21) Appl. No.: 11/265,625

(22) Filed: Nov. 2, 2005

(65) Prior Publication Data

US 2007/0096395 A1 May 3, 2007

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 5,100,139 | A * | 3/1992 | Di Bella | 273/292 |
| 5,314,193 | A * | 5/1994 | Ferrer | 273/292 |
| 5,366,228 | A * | 11/1994 | Kangsanaraks | 273/292 |
| 5,368,305 | A * | 11/1994 | Rodda et al. | 273/292 |
| 5,397,128 | A * | 3/1995 | Hesse et al. | 273/292 |
| 5,407,208 | A * | 4/1995 | Keller et al. | 273/274 |
| 5,411,268 | A * | 5/1995 | Nelson et al. | 273/292 |
| 5,632,486 | A | 5/1997 | Mkrtchyan | |
| 5,772,211 | A * | 6/1998 | Nazaryan et al. | 273/292 |
| 6,003,869 | A * | 12/1999 | Kuo | 273/292 |
| 6,079,713 | A * | 6/2000 | Paz | 273/292 |
| 6,220,959 | B1 * | 4/2001 | Holmes et al. | 463/13 |
| 6,336,858 | B1 * | 1/2002 | Yoseloff | 463/13 |
| 6,368,212 | B1 * | 4/2002 | Moody | 463/13 |
| 6,386,539 | B1 * | 5/2002 | Deskovick | 273/153 J |
| 6,550,772 | B1 * | 4/2003 | Streeks et al. | 273/292 |
| 6,554,281 | B2 * | 4/2003 | Flannery | 273/274 |
| 6,604,740 | B1 * | 8/2003 | Singer et al. | 273/292 |
| 6,682,073 | B2 * | 1/2004 | Bryant et al. | 273/138.1 |
| 7,025,354 | B1 * | 4/2006 | Jones | 273/292 |
| 7,195,244 | B1 * | 3/2007 | Feola | 273/292 |
| 2006/0128456 | A1 * | 6/2006 | Berman et al. | 463/13 |
| 2006/0197284 | A1 * | 9/2006 | Jones | 273/274 |
| 2007/0010307 | A1 * | 1/2007 | Falciglia | 463/13 |
| 2007/0129134 | A1 * | 6/2007 | Barrie | 463/20 |

* cited by examiner

*Primary Examiner*—Gene Kim
*Assistant Examiner*—Dolores Collins
(74) *Attorney, Agent, or Firm*—Porzio, Bromberg & Newman, P.C.

(57) ABSTRACT

The invention relates to a method for playing a card game using a grid in which game pieces are placed in a grid configuration. Hands are selected from the game pieces. A value is determined from the selected hand. For example, the grid configuration can include a triangular grid configuration, square grid configuration, outer square grid configuration, right angle triangular grid configuration, diamond grid configuration or stacked grid configuration. In one embodiment, a hand can be selected from three game pieces having each of the game pieces adjacent to another game piece. In one embodiment, the grid configuration is determined during play by one or more players adding game pieces to an initial grid configuration. Play against more than one player can continue in a survivor fashion with the loser's hand leaving the game on each round until only one player remains. A betting board can be used with the game.

25 Claims, 16 Drawing Sheets

10

METHOD AND DEVICE FOR PLAYING A GAME USING A GRID

BACKGROUND OF THE INVENTION

1. Field of the Invention

The invention relates to games, such as a game in which a grid is used for distribution of game pieces.

2. Description of Related Art

Variations in card games using card point values are known. In games such as black jack, a point value of cards is each player's hand is added together to determine the value of the hand after the player had the opportunity to be dealt additional cards. Different hands are compared to determine the winning hand, such as comparing the hand against the dealer hand.

U.S. Pat. No. 5,632,486 describes a method of playing a card game using a card number subtracting technique in which cards of the playing deck are assigned numerical point values. Eights, nines and tens are removed from the standard deck to establish a deck of forty cards. Each numbered card is assigned its point value. Each ace is assigned a value of one. Each face card is assigned a value of zero. Two cards are initially dealt to each player with each player having the option of receiving a third card. If a third card is dealt, one of the cards is discarded. The hands are compared to determine a winning hand as the hand in which the point value difference between the two cards in the hand is closest to zero.

It is desirable to provide a game for enhancing a player's interest.

SUMMARY OF THE INVENTION

The invention relates to a method for playing a card game using a grid in which game pieces are placed in a grid configuration. Hands are selected from the game pieces. A value is determined from the selected hand. For example, the grid configuration can include a triangular grid configuration, square grid configuration, outer square grid configuration, right angle triangular grid configuration, diamond grid configuration, rectangular grid configuration or stacked grid configuration. The game pieces can be placed in a face-up position which reveals the value of the game piece or a face down position which does not reveal the value of the game piece. In one embodiment, a hand can be selected from three game pieces having each of the game pieces adjacent to another game piece. The game pieces can be, for example, a conventional deck of cards, Mah Jongg tiles, dice or dominoes. Players can play either against each other or the dealer with a hand having the highest value being determined by the dealer or the players.

In one embodiment, hands of game pieces can be interlocking in which at least one of the hands has a game piece in common with another one of said hands. In an alternate embodiment, hands of game pieces can be non-interlocking in which each of the hands care individual and do not have any game pieces in common with another hand.

In one embodiment, the grid configuration is determined during play by one or more players determined as a shooter adding game pieces to an initial grid configuration. Play against more than one player can continue in a survivor fashion with the loser's hand leaving the game on each round until only one player remains. A betting board can be used with the game.

The invention will be more fully described by reference to the following drawings.

DETAILED DESCRIPTION

Figure 1:
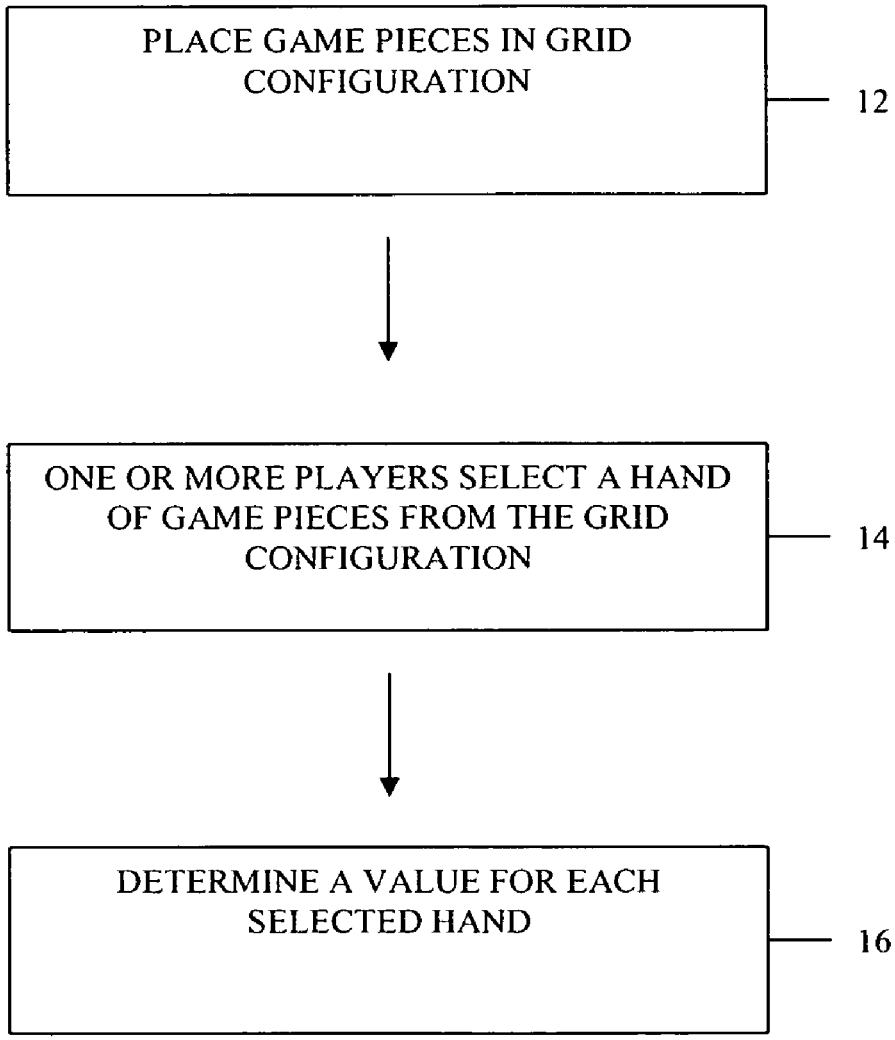
FIG. 1 is a flow diagram of a method for playing a game.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a flow diagram of a method for playing a game using grid 10. In block 12, game pieces are placed in a grid configuration. For example, game pieces 21 can be from a conventional deck of cards or ten cards or subset thereof, such as an ace, two, three, four, five, six, seven, eight, nine or ten. In an alternate embodiment, Mah Jongg tiles can be used as game pieces. A number of Mah Jongg tiles are dealt to a player. Each of the Mah Jongg tiles is assigned the same point value as the values on the face of the Mah Jongg tiles.

Alternatively, the game pieces can be one or more dominoes or die. The assigned point values of the game pieces are determined by the corresponding numbers of dots or numbers on the game pieces. In one embodiment, a predetermined number of dice are rolled for each player. For example, the number of dice can be two through six die. For example, game pieces 21 can be placed by a dealer into the grid configuration. The pattern of the grid configuration is selected to determine a number of hands.

Figure 2A:
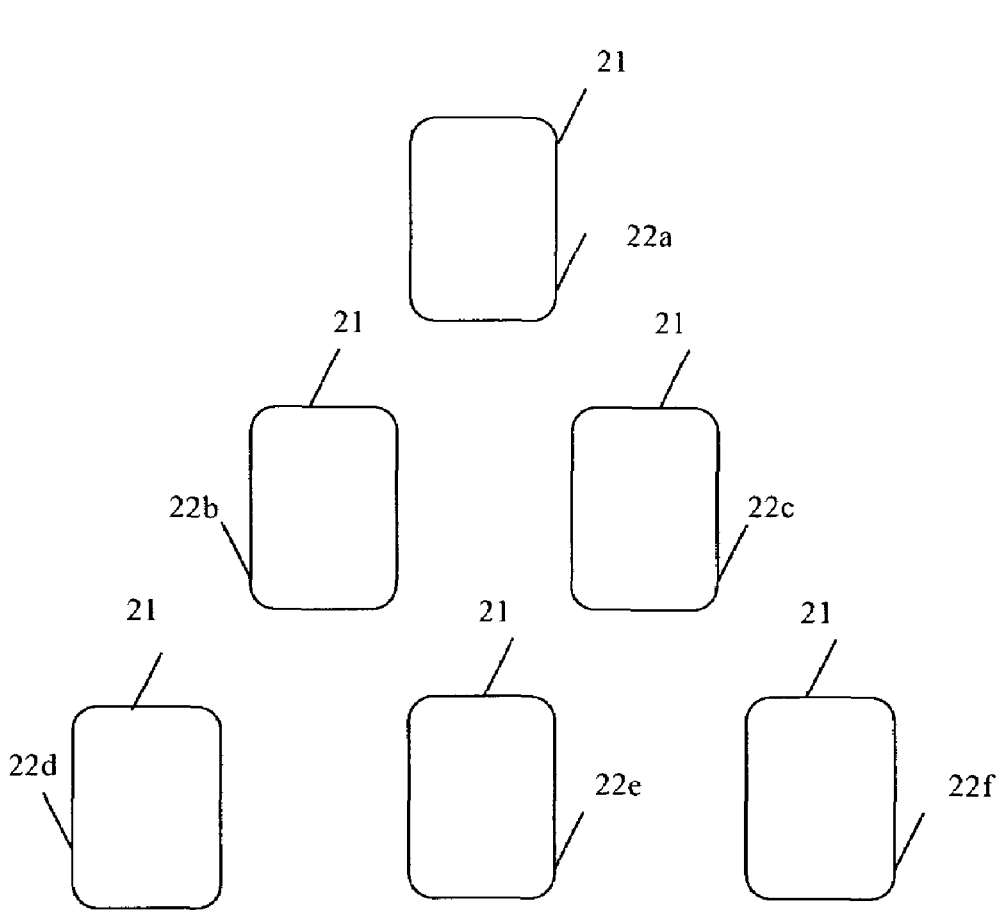
FIG. 2A is a schematic diagram of a triangular grid configuration for game pieces.

Referring to FIG. 2A, for example, game pieces can be placed in triangular grid configuration 20. Each game piece 21 is placed in triangular grid configuration 20 in either a face-up position which reveals the value of the game piece or a face-down position which does not reveal the value of the game piece. In one embodiment, at least one game piece 21 is placed in a face-up position and at least one game piece 21 is placed in a face-down position. In one embodiment, game pieces 21 are placed in a face-up position at corner positions 22*a*, 22*b* and 22*f*, and game pieces 21 are placed in a face-down position at middle positions 22*b*, 22*c* and 22*e*. Game pieces 21 which are placed in the face-up position can be placed first in triangular grid configuration 20 and game pieces to be placed in the face-down position can be placed in triangular grid configuration 20 after the placement of game pieces 21 which are placed in a face-up position. Alternatively, game pieces 21 which are placed in the face-down position can be placed first in triangular grid configuration 20 and game pieces to be placed in the face-up position can be placed in triangular grid configuration 20.

Figure 2B:
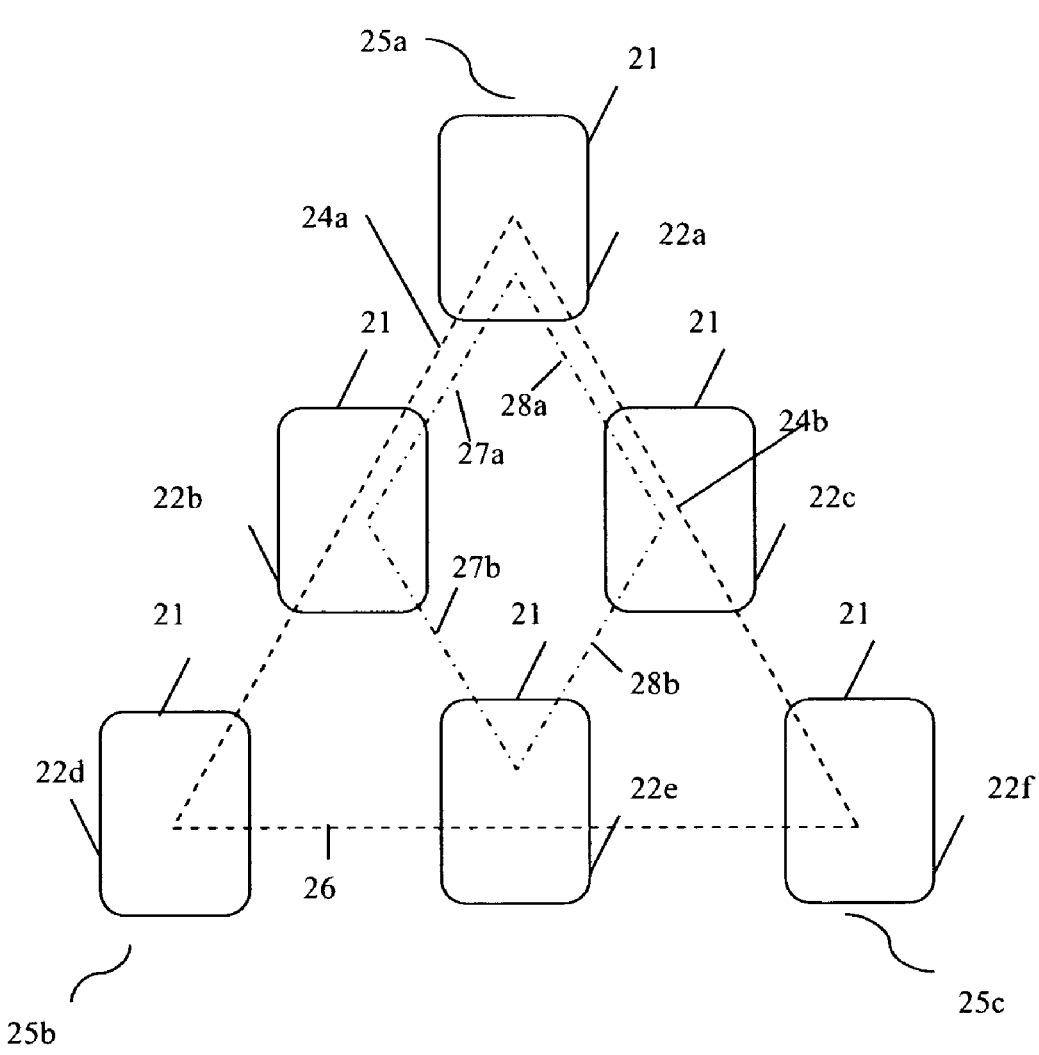
FIG. 2B is a schematic diagram of a triangular grid configuration for game pieces including a representation of possible hands.

Referring to FIG. 1, in block 14, one or more players select a hand of game pieces from the grid configuration. The hand of game pieces can be determined from game pieces 21 which are adjacent to at least one other game piece 21 or from game pieces 21 which are not adjacent to one another. Referring to FIG. 2B, for triangular grid configuration 20, six game pieces 21 are used to provide hands of three game pieces 21. For example, this grid configuration can be used to play a three card poker game. Example hands include a first hand formed of game pieces 21 in positions 22*a*, 22*b* and 22*d* along diagonal 24*a*. A second hand can be formed of game pieces 21 in positions 22*a*, 22*c* and 22*f* along diagonal 24*b*. A third hand can be formed of game pieces 21 in positions 22*a*, 22*b* and 22*c* adjacent corner 25*a*. A fourth hand can be formed of game pieces 21 in positions 22*d*, 22*b* and 22*e* adjacent corner 25*b*. A fifth hand can be formed of game pieces 21 in positions 22*f*, 22*c* and 22*e* adjacent corner 25*c*. A sixth hand can be formed of game pieces 21 in positions 22*d*, 22*e* and 22*f* along horizontal row 26. A seventh hand can be formed of game pieces 21 in positions 22*a*, 22*b* and 22*e* along diagonals 27*a* and 27*b*. An eighth hand can be formed of game pieces 21 in positions 22*a*, 22*c* and 22*e* along diagonals 28*a* and 28*b*. A ninth hand can be formed of game piece 21 in position 22*a* in corner 25*a*, game piece 21 in position 22*d*in corner 25*b* and game piece 21 in position 22*f* in corner 25*c*.

Referring to FIG. 1, in block 16, a value is determined for each selected hand. For example, each hand can be matched to a value determined from conventional card game values, such as a straight flush, three of a kind, straight, flush, pair or high card. Card values can be ordered from highest to lowest. In one embodiment, a numerical value can be determined for each value of a conventional card game. For example, a value of ten can be assigned to a straight flush, a value of seven can be assigned to a three of a kind, a value of five can be assigned to a straight, a value of four can be assigned to a flush, a value of three can be assigned to a pair and a value of one can be assigned to a high card. Players can play either against each other or the dealer with a hand having the highest value being determined the winner by the dealer or the players.

In one embodiment, a bonus wager can be placed during block 14. One of the hands can be selected to have a bonus feature before selection of the hand for play. Thereafter, the same hand as having the bonus feature or a different hand can be selected for play in block 16. Alternatively, a bonus wager can be made on a certain combination of game pieces 21 which can be determined from one of hands. For example, the certain combination of game pieces can be three of a kind. If the selected hand includes the bonus feature, the player is a winner.

Figure 3A:
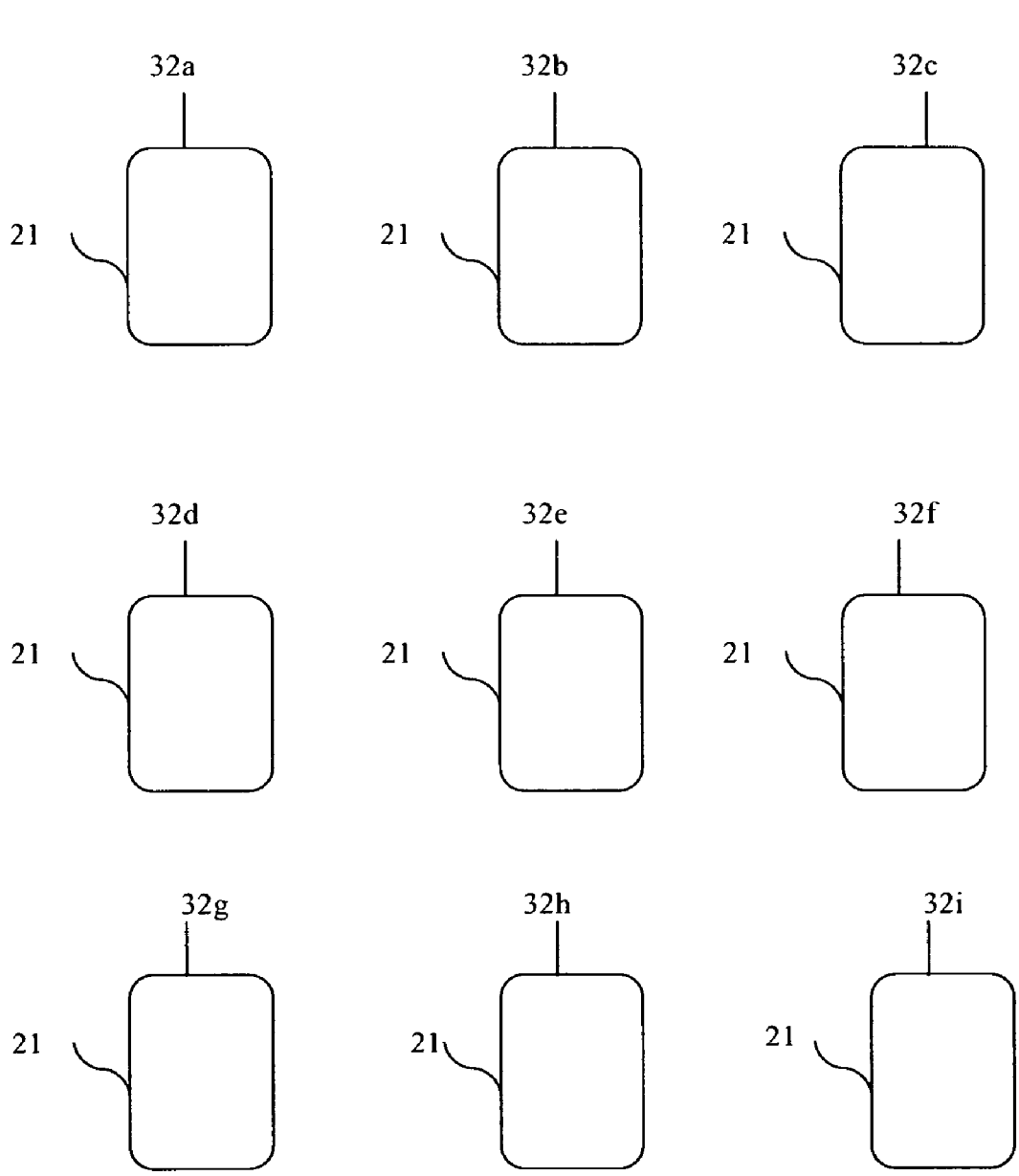
FIG. 3A is a schematic diagram of a square grid configuration for game pieces.

FIG. 3A is a schematic diagram of an alternate embodiment including square grid configuration 30. Game pieces 21 are placed in square grid configuration 30 in either a face-up position which reveals the value of game pieces 21 or a face-down position which does not reveal the value of game pieces 21. In one embodiment, game pieces 21 are placed in a face-up position at corner positions 32*a*, 32*c*, 32*g* and 32*i* and center position 32*e*. Game pieces 21 are placed in a face-down position at positions 32*b*, 32*d*, 32*f*, and 32*h*. For example, game pieces 21 which are to be positioned face-up can be placed in square grid configuration 30 first and thereafter game pieces to be positioned face-down can be placed in square grid configuration 30.

Figure 3B:
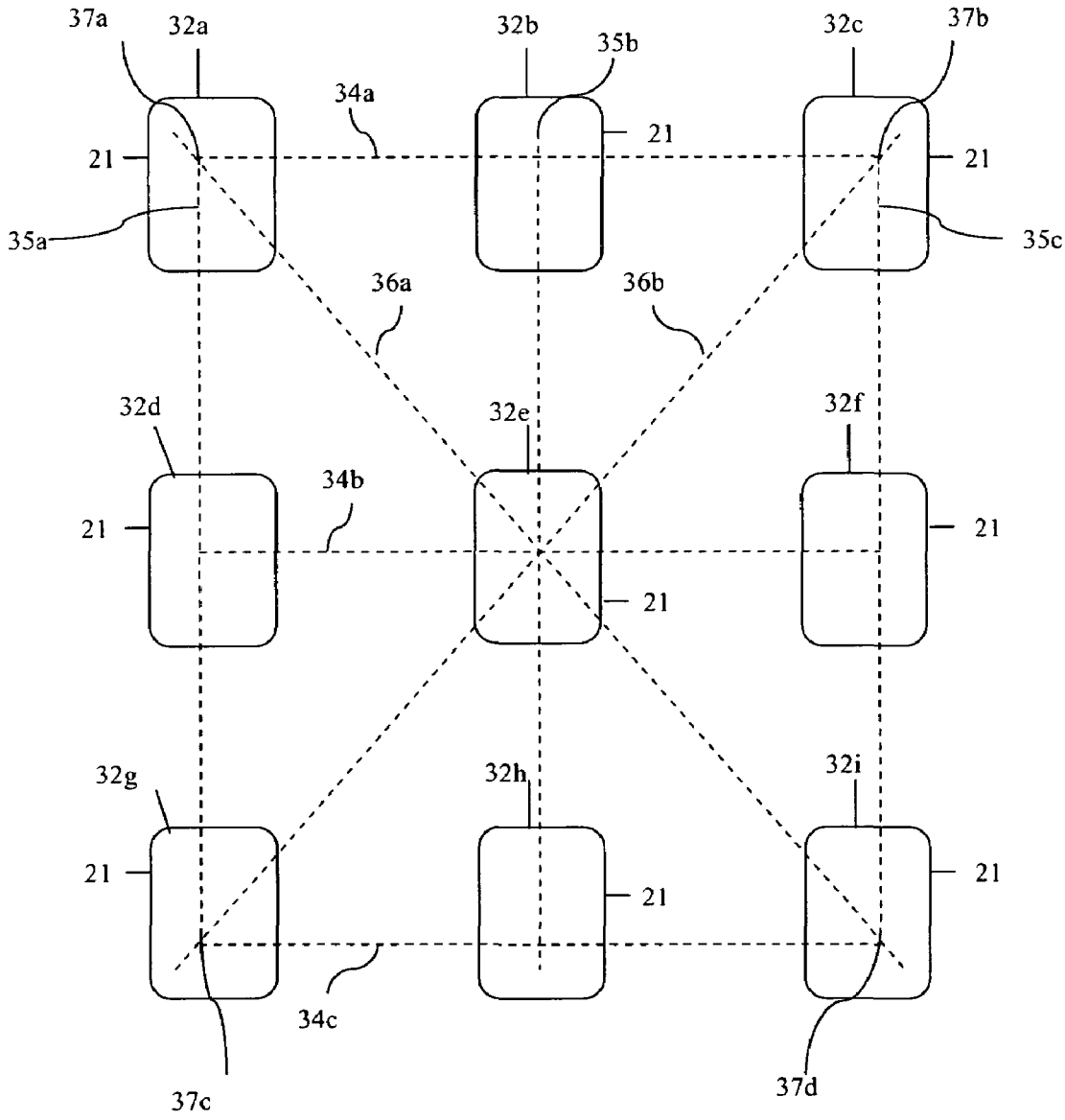
FIG. 3B is a schematic diagram of a square grid configuration for game pieces including a representation of possible hands.

Hands of game pieces 21 can be determined from game pieces 21 positioned three in a row along a diagonal, vertical or horizontal row, as shown in FIG. 3B. A first hand can be formed of game pieces 21 in positions 32*a*, 32*b* and 32*c* along horizontal row 34*a*. A second hand can be formed of game pieces 21 in positions 32*d*, 32*e* and 32*f* along horizontal row 34*b*. A third hand can be formed of game pieces 21 in positions 32*g*, 32*h*, and 32*i* along horizontal row 34*c*. A fourth hand can be formed of game pieces 21 in positions 32*a*, 32*d*, and 32*g* along vertical row 35*a*. A fifth hand can be formed of game pieces 21 in positions 32*b*, 32*e*, and 32*h* along vertical row 35*b*. A sixth hand can be formed of game pieces 21 in positions 32*c*, 32*f*, and 32*i* along vertical row 35*c*. A seventh hand can be formed of game pieces 21 in positions 32*a*, 32*e*, and 32*i* along diagonal row 36*a*. An eighth hand can be formed of game pieces 21 in positions 32*c*, 32*e*and 32*g* along diagonal row 36*b*. Alternatively, game piece can be determined from three game pieces 21 positioned at any location in square grid configuration 30.

In an alternate embodiment, game pieces 21 are placed in a face-up position at positions 32*a*, 32*d* and 32*g* of vertical row 35*a* and at positions 32*b* and 32*h*. In this embodiment, the first hand formed of game pieces along horizontal row 34*a* and the third hand formed of game pieces along horizontal row 34*c* have two game pieces 21 positioned face-up and one game piece 21 positioned face-down. The fourth hand formed of game pieces along vertical row 35*a* has all game pieces 21 positioned face-up. The sixth hand formed of game pieces along vertical row 35*c* has all game pieces 21 positioned face-down. The second hand formed of game pieces along horizontal row 34*b*, the seventh hand formed of game pieces along diagonal row 36*a* and the eighth hand formed of game pieces along diagonal row 36*b* have one game piece 21 positioned face-up and two game pieces 21 positioned face-down.

In an alternate embodiment, game pieces 21 are placed in a face-up position at position 32*a*, 32*d* and 32*g* of vertical row 35*a* and at position 32*e*. In this embodiment, the first hand formed of game pieces along horizontal row 34*a* and the third hand formed of game pieces along horizontal row 34*c* have one game piece 21 positioned face-up. The fourth hand formed of game pieces along vertical row 35*a* has all game pieces 21 positioned face-up. The sixth hand formed of game pieces along vertical row 35*c* has all game pieces 21 positioned face-down. The second hand formed of game pieces along horizontal row 34*b*, the seventh hand formed of game pieces along diagonal row 36*a* and the eighth hand formed of game pieces along diagonal row 36*b* has two game pieces 21 positioned face-up.

In an alternate embodiment, additional hands can be formed of game pieces adjacent to corner 37*a*, 37*b*, 37*c* or 37*d*. For example, a hand can be formed of game pieces 32*a*, 32*b*, and 32*d* or 32*a*, 32*b*, and 32*e* which are adjacent to corner 37*a*. Additional hands can also be formed adjacent to center 38. For example, hands can be formed of game pieces 32*b*, 32*e* and 32*d*; 32*b*, 32*e* and 32*f*; 32*c*, 32*e* and 32*f*; 32*e*, 32*f*and 32*h*; or 32*d*, 32*e* and 32*h*. Alternatively, a hand can be formed of three game pieces in any of positions 32*a*-32*h*.

Figure 4A:
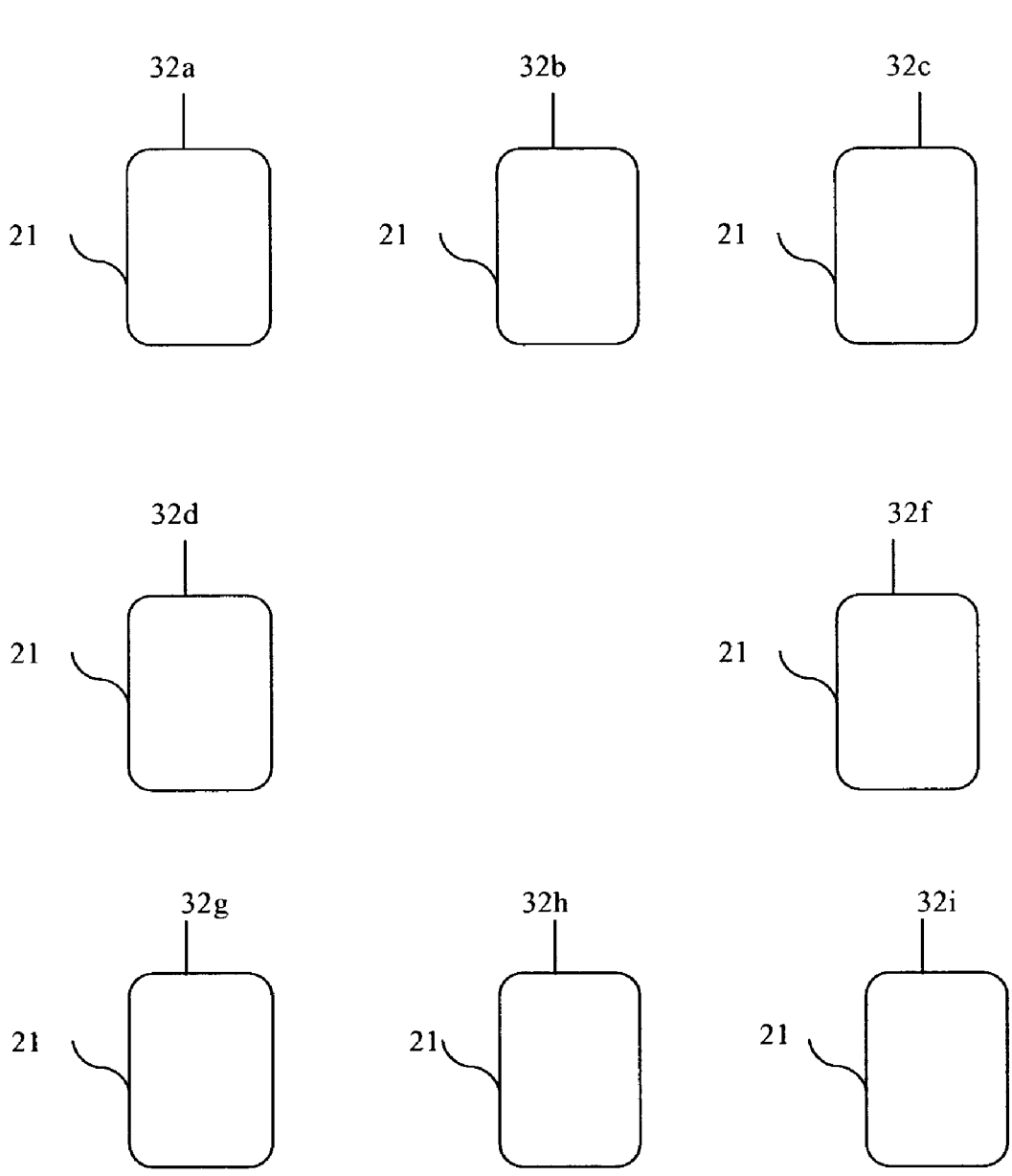
FIG. 4A is a schematic diagram of an outer square grid configuration for game pieces.
Figure 4B:
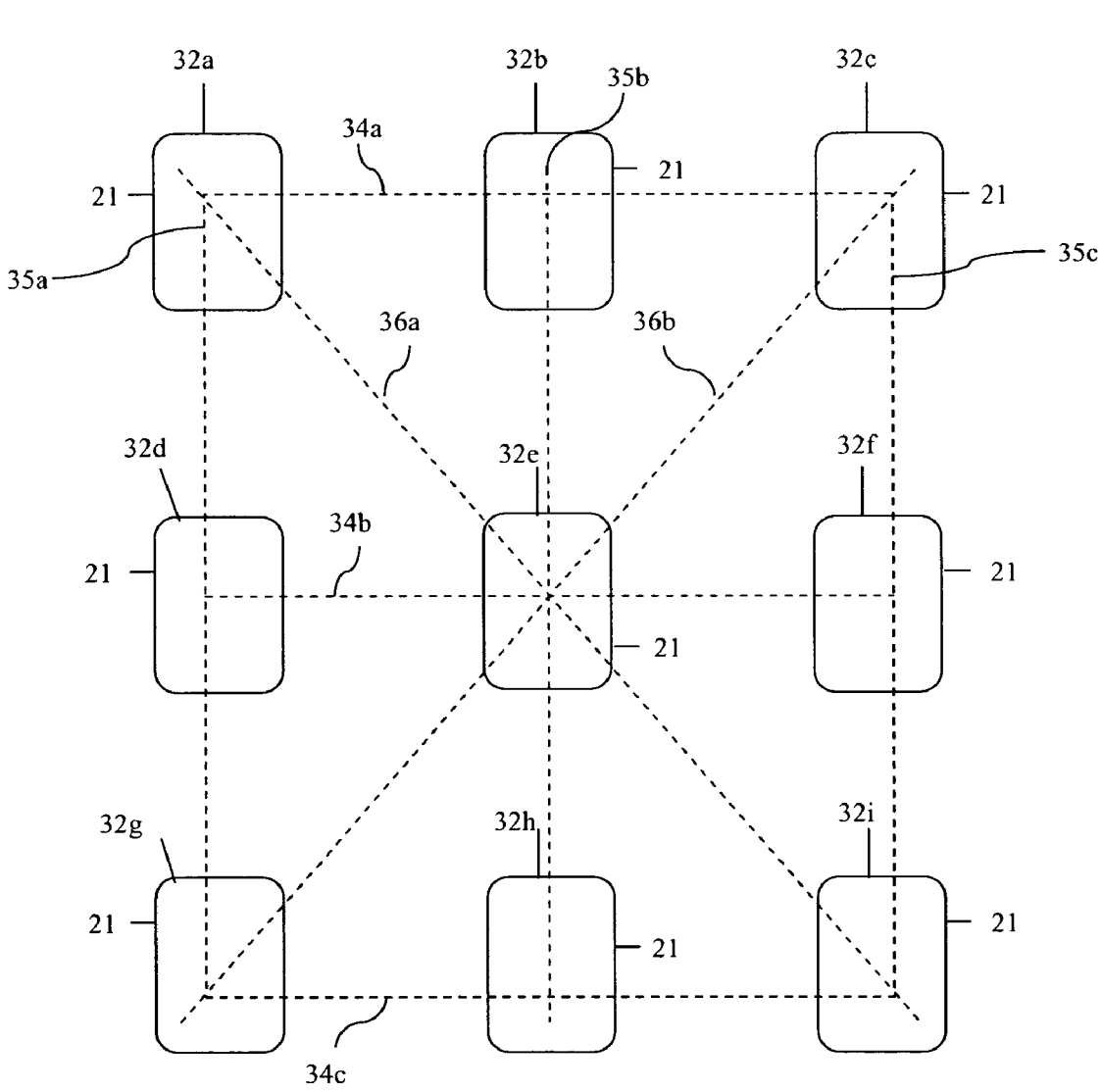
FIG. 4B is a schematic diagram of an outer square grid configuration for game pieces after placement of a game piece in the center.
Figure 5A:
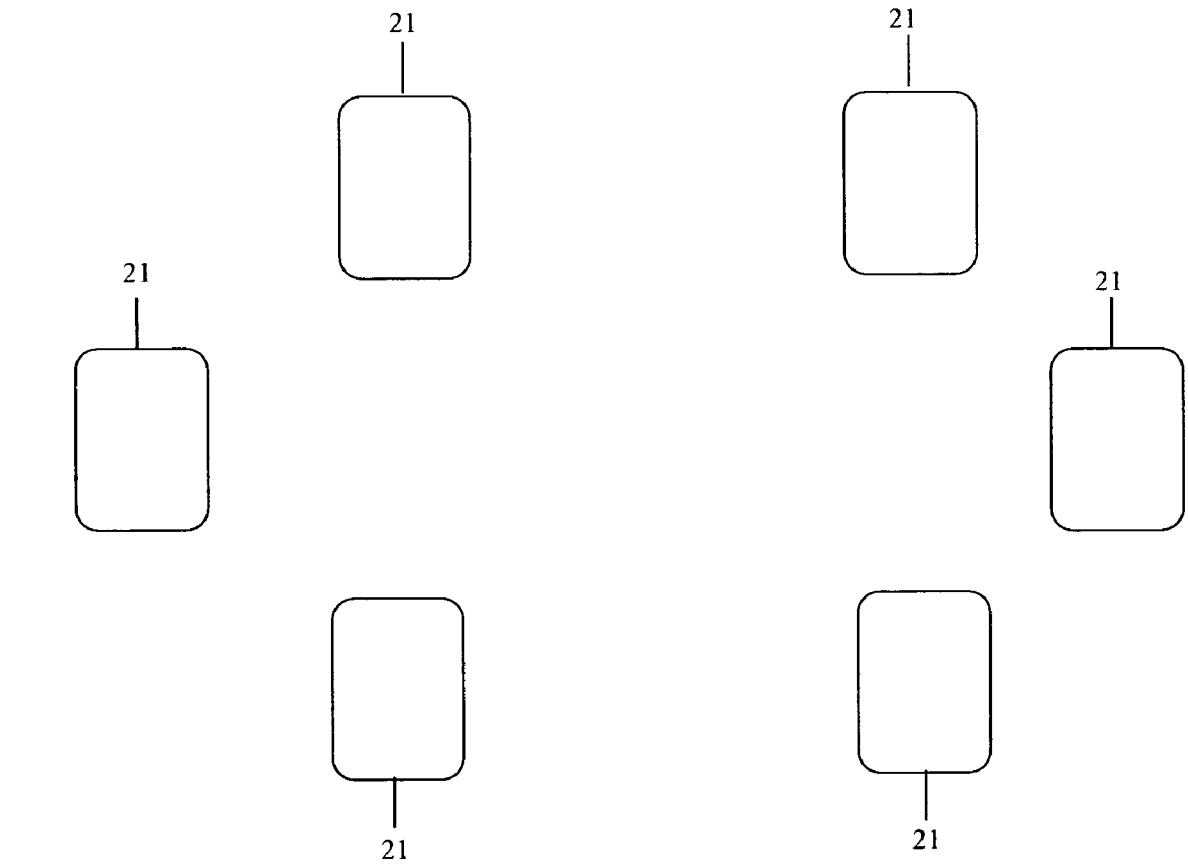
FIG. 5A is a schematic diagram of a hexagonal grid configuration for game pieces.
Figure 5B:
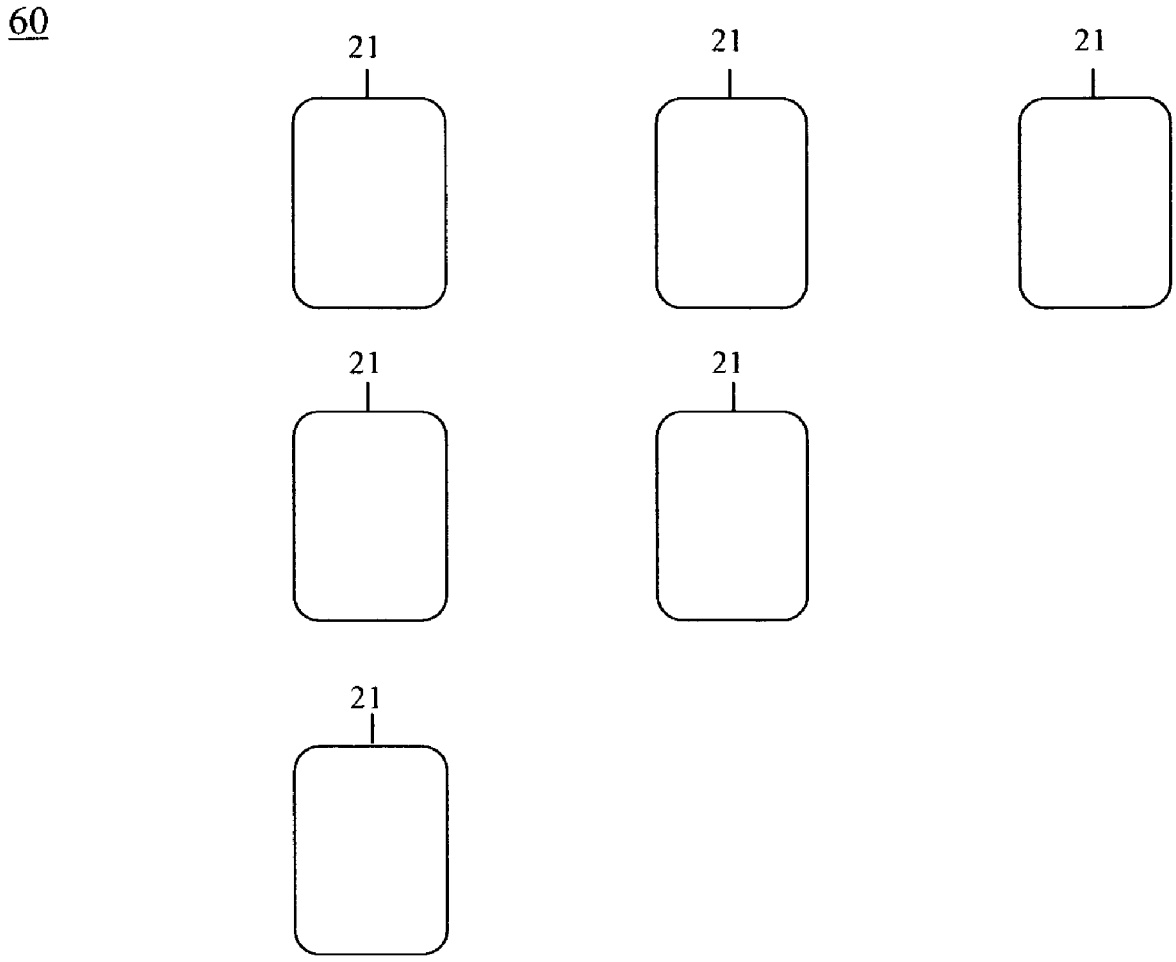
FIG. 5B is a schematic diagram of a right angle triangular grid configuration for game pieces.
Figure 5C:
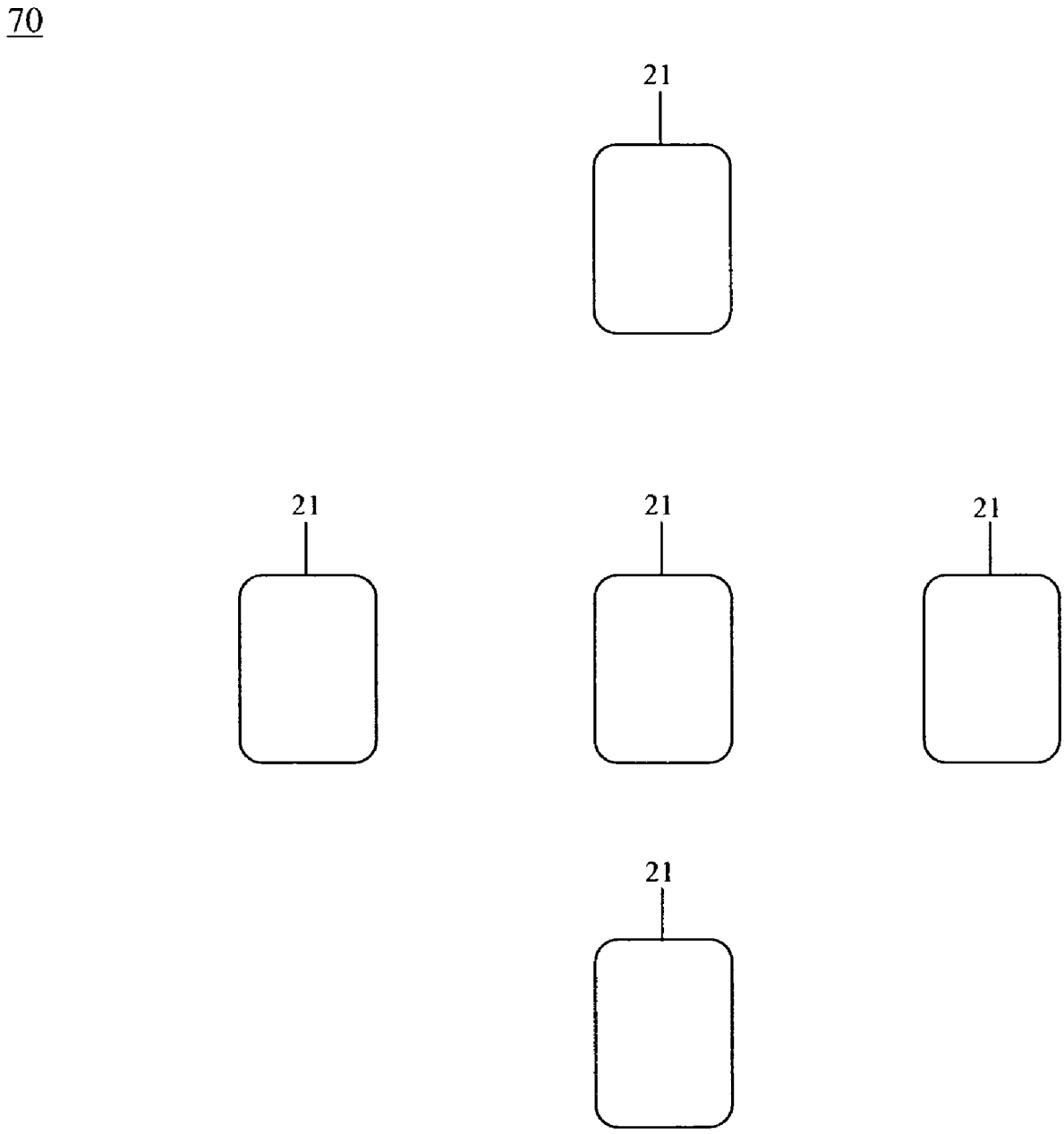
FIG. 5C is a schematic diagram of a diamond grid configuration for game pieces.
Figure 5D:
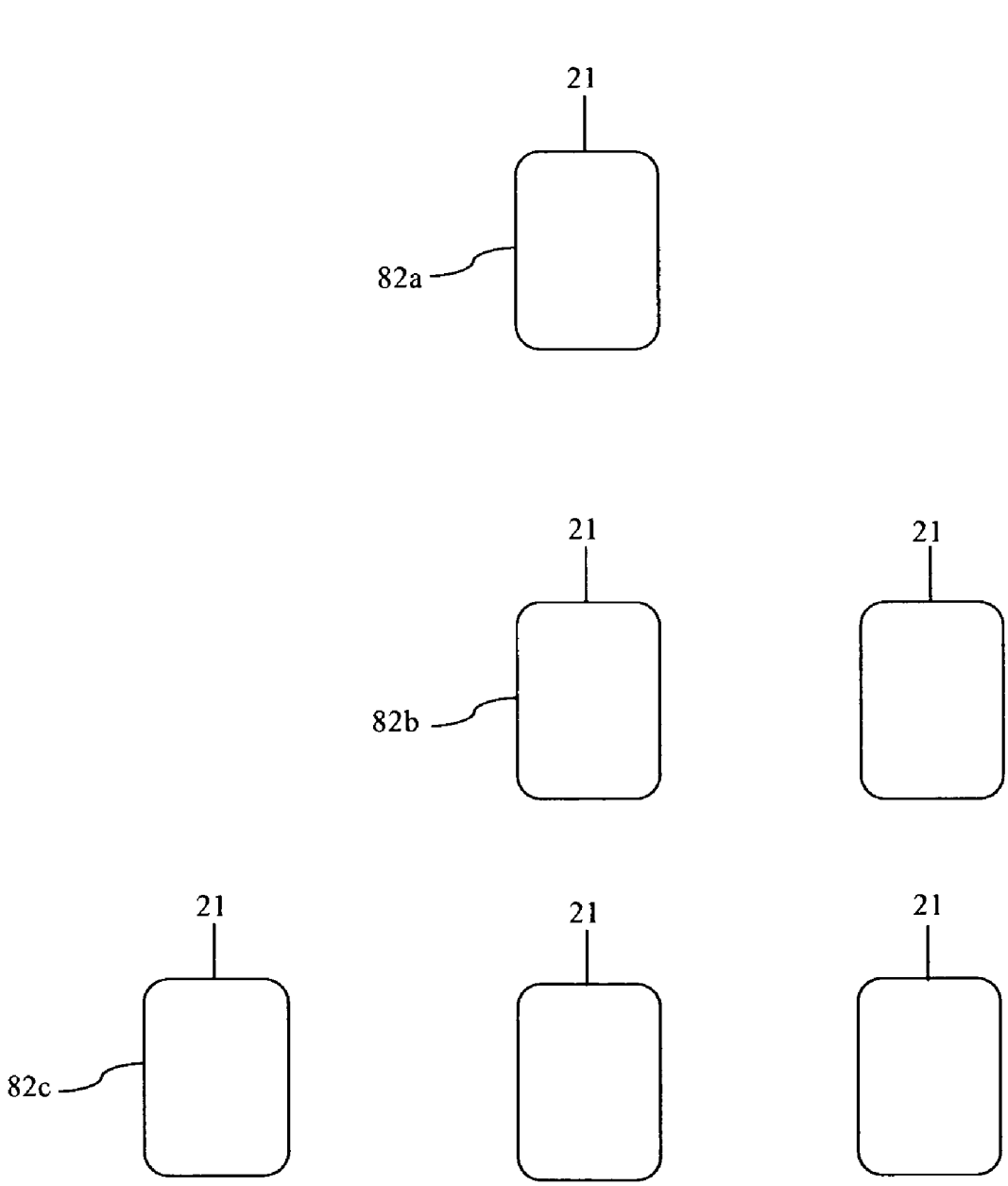
FIG. 5D is a schematic diagram of a stacked grid configuration for game pieces.

FIG. 4A is an alternate embodiment including outer square grid configuration 40 in either a face-up position which reveals the value of game pieces 21 or a face-down position which does not reveal the value of game pieces 21. In one embodiment, game pieces 21 are placed in a face-up position at corner positions 32*a*, 32*c*, 32*g* and 32*i*. Game pieces 21 are placed in a face-down position at positions 32*b*, 32*d*, 32*f* and 32*h*. For example, game pieces 21 which are to be positioned face-up can be placed in outer square grid configuration 40 first and thereafter game pieces to be positioned face-down can be placed in outer square grid configuration 40. During play, after block 16 is performed, game piece 21 is placed in center position 32*e* in a face-down position, as shown in FIG. 4B. Blocks 14 and 16 are repeated to allow a player an opportunity to select another hand for a second round and determine if the value of the selected hand in the second round is greater than the value of the hand which was the highest during the first round of the game.

Alternative grid configurations 50-80, shown in FIGS. 5A-5D, can be used with the method for playing a game using a grid 20. Hands can be determined from three or more adjacent game pieces 21 positioned in any of grid configurations 50-80. For example, hands can be determined for four card poker, five card poker, six card poker or seven card poker.

Game pieces 21 can be placed in hexagonal grid configuration 50 in either a face-up position which reveals the value of game pieces 21 or a face-down position which does not reveal the value of game pieces 21.

Game pieces 21 can be placed in right angle triangular grid configuration 60 in either a face-up position which reveals the value of game pieces 21 or a face-down position which does not reveal the value of game pieces 21.

Game pieces 21 can be placed in diamond grid configuration 70 in either a face-up position which reveals the value of game pieces 21 or a face-down position which does not reveal the value of game pieces 21.

Game pieces 21 can be placed in stacked grid configuration 80 in either a face-up position which reveals the value of game pieces 21 or a face-down position which does not reveal the value of game pieces 21. Stacked grid configuration 80 can include one or more game pieces in each of rows 82*a*-82*c*.

Figure 6A:
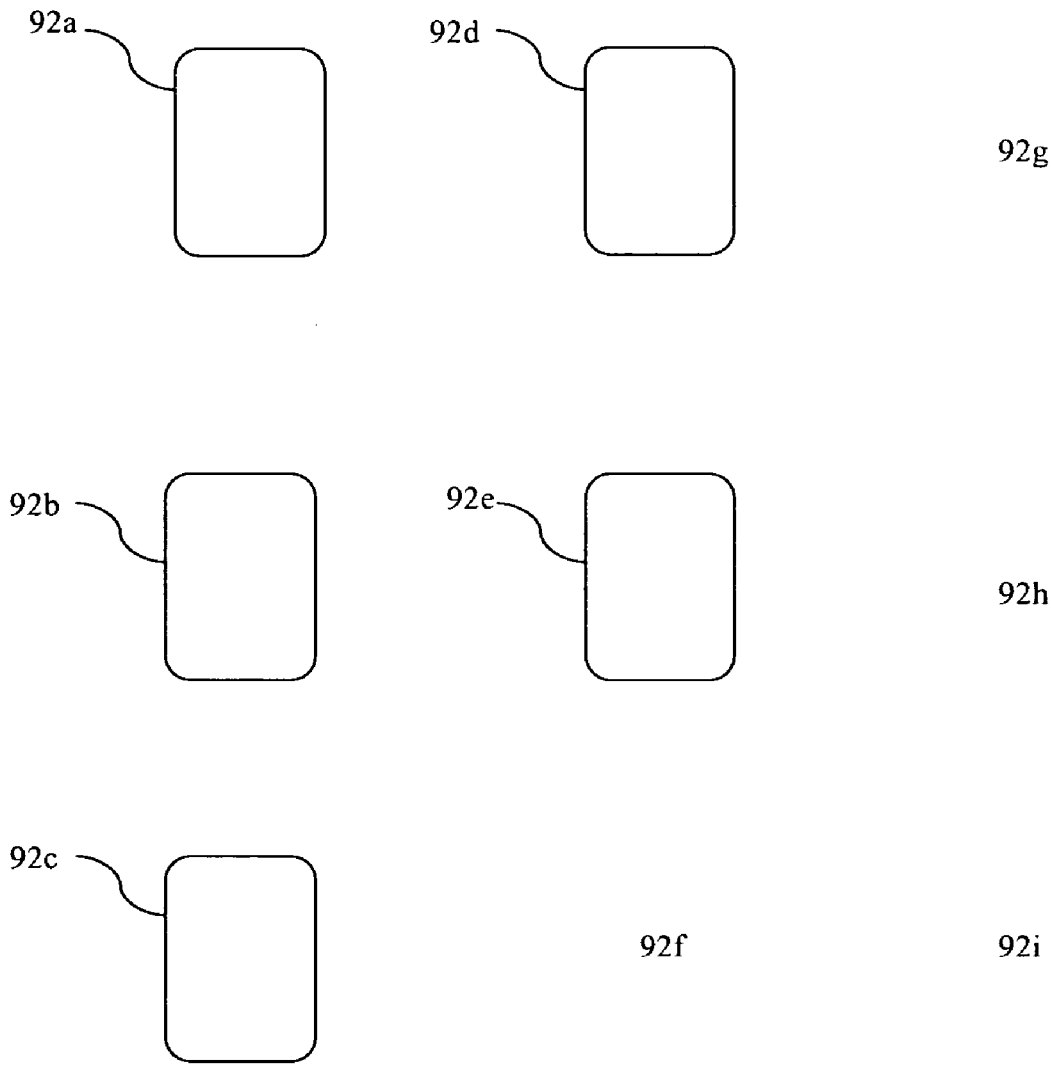
FIG. 6A is a schematic diagram of an initial grid configuration.
Figure 6B:
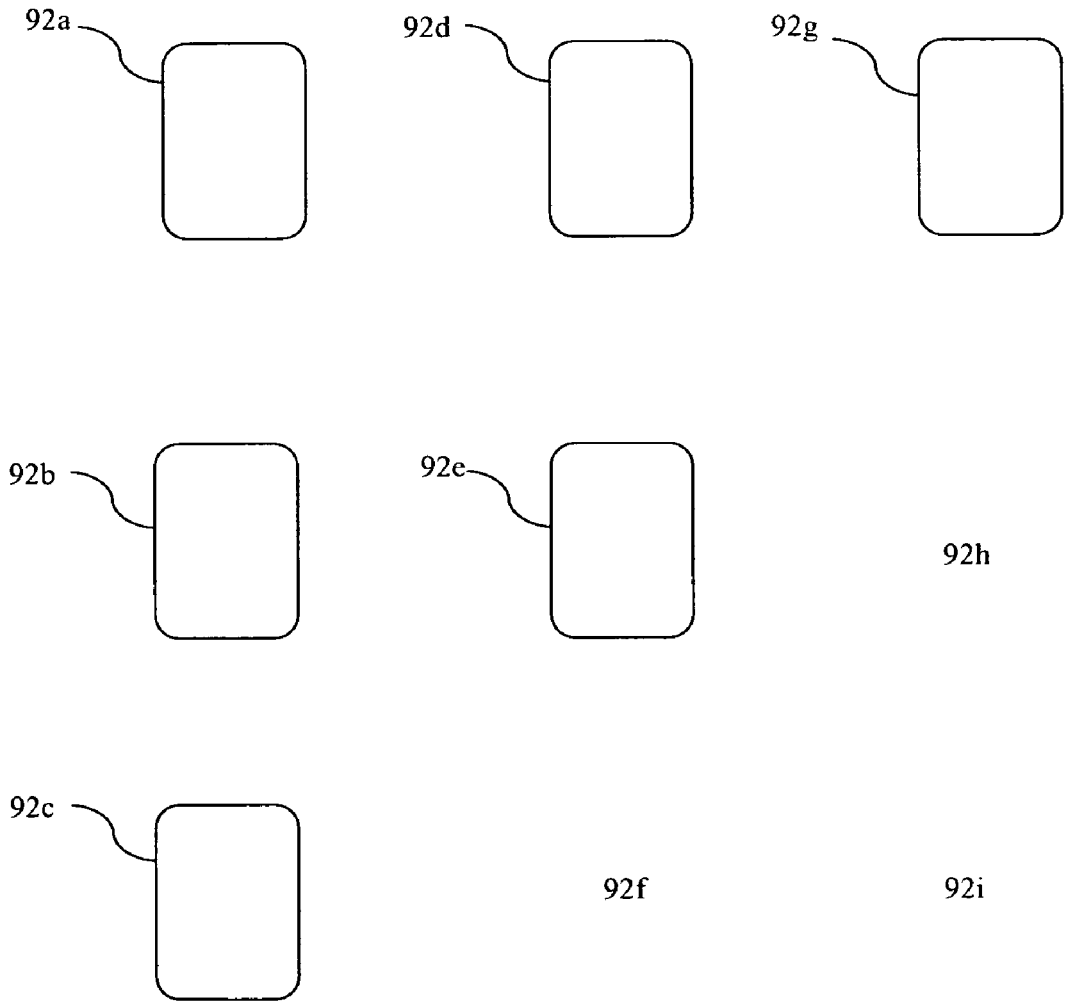
FIG. 6B is a schematic diagram of the grid configuration of FIG. 6A during play.

In one embodiment, a grid configuration is determined during play as shown in FIG. 6A. Initial grid configuration 90 includes game pieces in a face-up position at positions 92*a*, 92*b*, 92*c*, and 92*e*. Game piece 21 is placed in a face-down position at position 92*d*. Alternate embodiments can include game piece 21 in a face-up position in at least one of positions 92*a*-92*e* of initial grid configuration 90 and game pieces 21 in a face-down position in at least one of positions 92*a*-92*e* of initial grid configuration 90. A player is selected as a shooter. The player can be selected either by the dealer, by volunteering or by chance, using, for example, a spinner or dice. The player selected as the shooter can indicate the position for the dealer to place the next game piece 21. For example, the next game piece can be placed in a face-up position. The next face-up game piece 21 can be selected to be placed in one of positions 92*f*, 92*g*, 92*h* or 92*i*. For example, the next face-up game piece 21 can be selected to be placed in position 92*g*, as shown in FIG. 6B. Thereafter, the dealer fills in initial grid configuration 90 by placing face-down game pieces 21 at positions 92*f*, 92*h* and 92*i*. A first player selects a hand of game pieces 21. The hand can be selected from adjacent game pieces 21 as described above for the square grid configuration 30. After the first player selects one of the hands, additional players and/or the dealer can select remaining hands. The player with the hand having the highest value is determined the winner in block 16. The player that is determined the winner can be selected as the shooter for the next game. Play can continue in a survivor fashion with a player having a hand with the lowest point value leaving the game on each round until only one player remains.

Alternatively, a number can be assigned to each of the hands in one of the grid configurations. A dice or spinner can be used by each player to select one or the assigned numbers for a hand in one of the above-described grid configurations. Thereafter, the hand matching the assigned number is played by the player.

Figure 7:
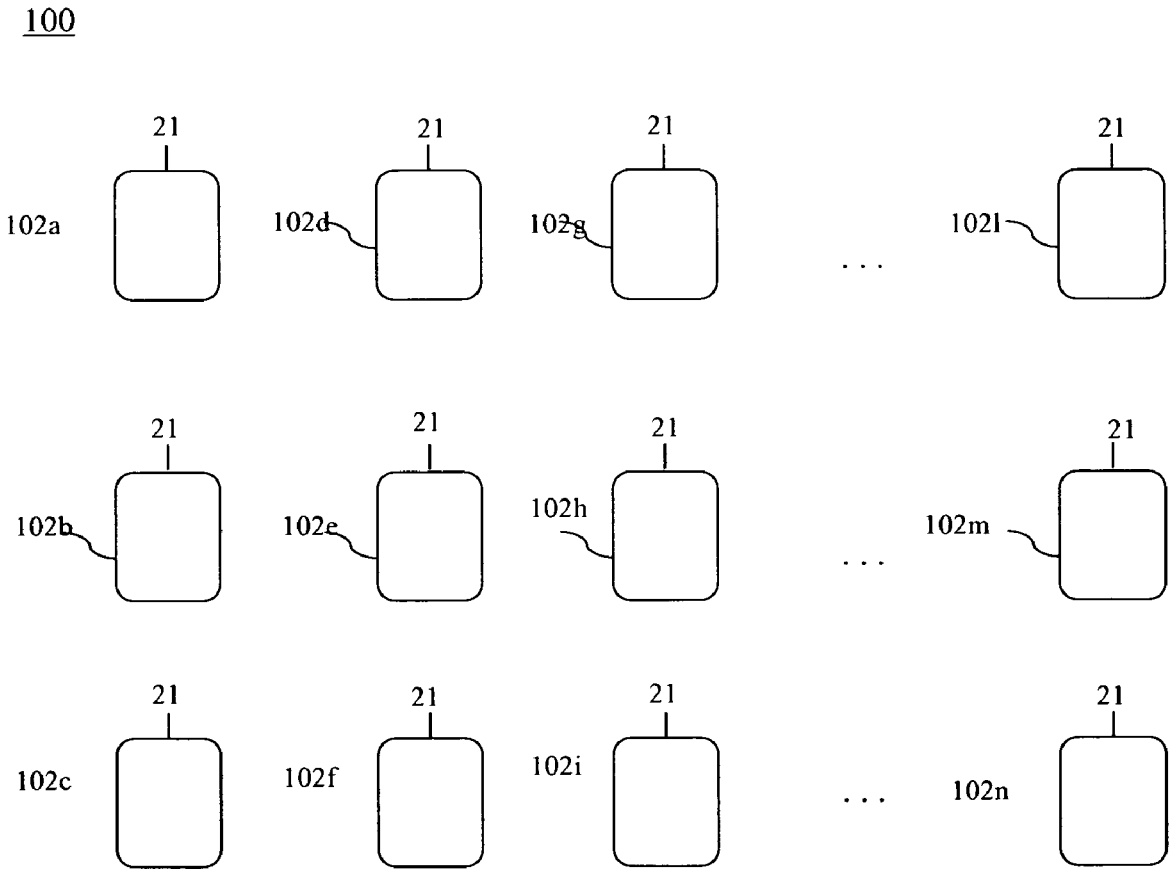
FIG. 7 is a schematic diagram of a rectangular configuration of game pieces.

FIG. 7 is an alternate embodiment, including rectangular grid configuration 100. A predetermined number of vertical rows 100*a*-100*n* are used to determine a predetermined number of hands. Game pieces 21 are placed in a rectangular grid configuration 100 in either a face-up position which reveals the value of game pieces 21 or a face-down position which does not reveal the value of game pieces 21. A hand comprises three game pieces in one of vertical rows 100*a*-100*n*. In alternate embodiments, additional game pieces 21 can be placed in each of vertical rows 100*a*-100*n* to determine the number of game pieces 21 for each hand, for example, hands of four or five game pieces can be used.

Figure 8:
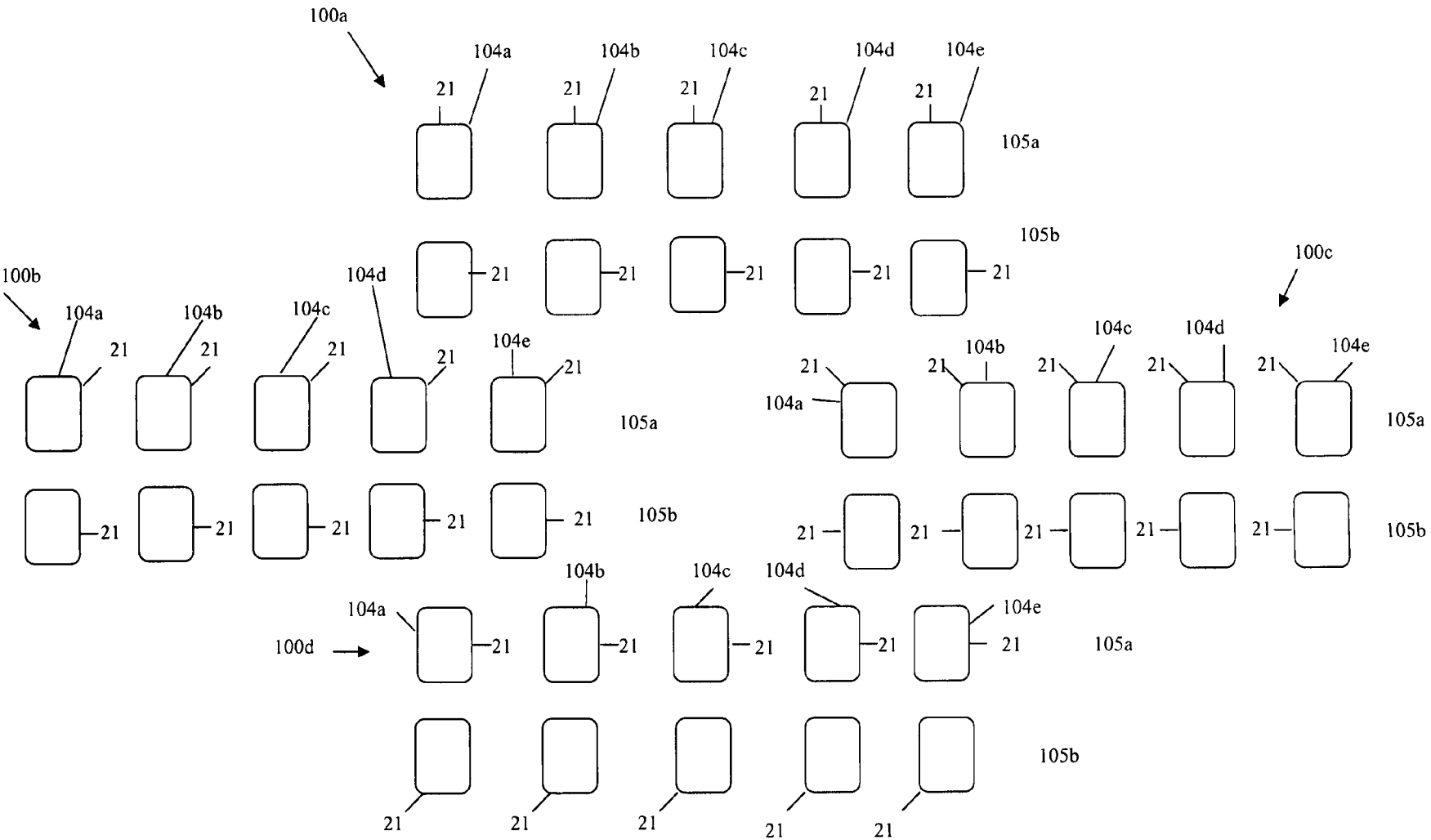
FIG. 8 is a schematic diagram of a plurality of rectangular grid configurations for game pieces.

FIG. 8 is an alternate embodiment in which rectangular grid configurations 100*a*-100*d* are used to play a game similar to Pi Guo Poker. Game piece 21 can be placed in a face-up position or face-down position in each of grid configurations 100*a*-100*d*. It will be appreciated that additional grid configurations 100 can be dealt depending on the number of players to play the game. A five game piece hand is selected from game pieces 21 positioned in one of the horizontal rows 100*a*or 100*b* in one of grid configuration 100*a*-100*d*. A two game piece hand is selected from game pieces 21 positioned in one of vertical rows 100*a*-100*e* from one of grid configurations 100*a*-100*d* which can be the same or different grid configurations as selected for the five game piece hand. A player is determined a winner if both the selected five game piece hand and the selected two game piece hand have the highest value of the selected hands. Alternatively, a player is determined a winner if with the selected five game piece hand or the selected two game piece hand is determined as having the highest value of the other selected hands. In an alternate embodiment, hands can be formed of two or more game pieces 21 positioned in any location in one of grid configurations 40-90.

In an alternate embodiment, one or more players are each dealt a hand of game pieces 21. Each hand of game pieces 21 can be dealt from a different set or deck of game pieces 21. Accordingly, each player can be assigned an individual set or deck of game pieces 21. For example, the hand of game pieces 21 can comprise three, four, five or six game pieces 21. Alternate hands of more or less game pieces can be used in various games. Referring to block 12, each of the players can place each of the dealt game pieces in any position in one of the grid configurations described above. For example, a grid configuration, such as square grid configuration 30, can be selected by the dealer and the same grid configuration is used by all players. The dealt game pieces 21 can be placed in a face-up position. After the player places game pieces 21 in the grid configuration, the dealer places game pieces 21 from the deck assigned to the player for each position in the grid configuration without a game piece to complete the grid configuration. Game pieces 21 can be placed by the dealer in a face-down position. Block 14 is performed to allow the player to select a hand from the determined grid configuration. For example, a player can be dealt five game pieces 21, such as cards, from an individual deck. The player places the five game pieces in square grid configuration 30 to provide a hand with a highest value. The dealer completes the grid configuration by placing four game pieces from the same individual deck of the player into the grid configuration.

In each of grid configurations 20, 30, 40, 50, 60, 70 or 80, 90 or 100 hands of game pieces 21 can be interlocking in which at least one of the hands has game piece 21 in common with another one of the hands. In an alternate embodiment, hands of game pieces can be non-interlocking in which each of the hands are individual and do not have any game piece 21 in common with another hand.

In one embodiment, a player or dealer determines if hands of game pieces include interlocking game pieces or non-interlocking game pieces. In one embodiment, a player can place a bet on either hands which have interlocking game pieces or hands which have non-interlocking game pieces.

Figure 9:
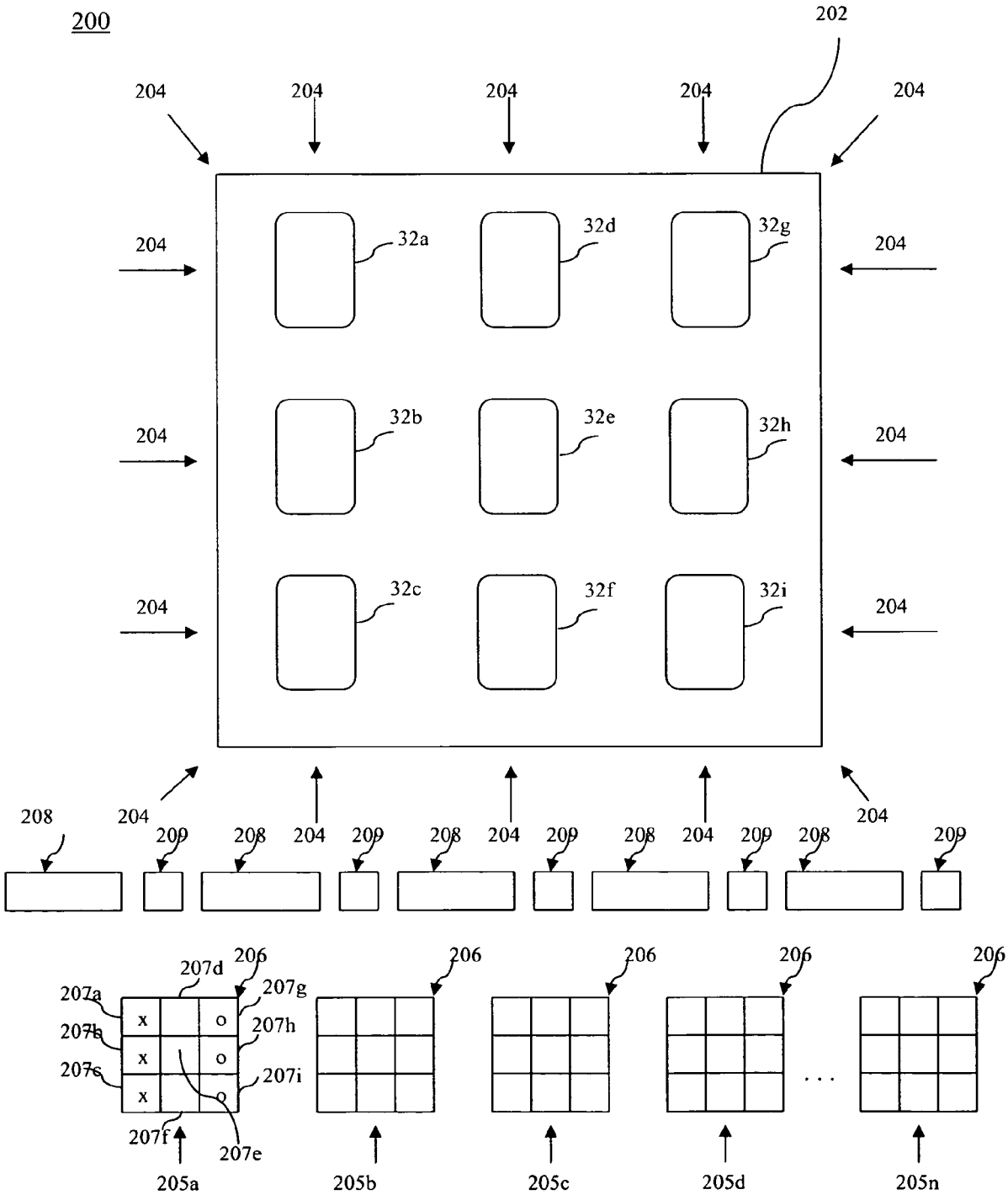
FIG. 9 is a schematic diagram of a betting board and controller used for selection of hand from a grid configuration.

Betting can take place using betting board 200, as shown in FIG. 9. Betting board 200 can be a gaming table. A dealer places game pieces 21 on dealer board 202 in one of grid configurations 20-100 described above according to block 12. In one embodiment, dealer board 202 is mechanically and/or electronically activated. Alternatively, dealer board 202 can be a video display and game pieces 21 are randomly selected and displayed on the video display. For example, if a square grid configuration 30 is used, arrows 204 adjacent dealer board 202 are illuminated to indicate possible hands. Each player selects a hand in block 14 using controllers 205*a*-205*n*. Controllers 205*a*-205*n* include a video display having touch surface 206 marked with positions 207*a*-207*i* of game pieces 21 corresponding to positions 32*a*-32*i* of the selected grid configuration on dealer board 202. Positions 32*a*-32*i* in the grid configuration can be selected with controller 205 by selecting corresponding positions 201*a*-207*i* and each position 207*a*-207*i* after selection is illuminated or marked to determine the hand. In one embodiment, positions 207*a*-207*i* are marked with an "X". For example, controller 205*a*can be used to select positions 207*a*, 207*b* and 207*c* to form a hand. A player places a bet in betting location 208 before or after selection of a hand. Controller 205*a*-205*n* can also cbe used to select a bonus feature for a hand of game pieces in positions 207*a*-207*i*. The bonus feature can be selected before the dealer places game pieces on dealer board 202. For example, controller 205*a* can be used to select positions 207*g*, 207*h* and 207*i* to form a hand for a bonus feature. In one embodiment, positions 207*a*-207*i* which are selected to have the bonus feature are marked with a circle. Selected hands can be displayed on respective controllers 205*a*- 205*n* and/or on dealer board 202. After the band is displayed, the hand and bet cannot be changed until dealer board 202 and controller 205*a*-205*n* are reset. Block 16 is performed to determine a value for each selected hand. In one embodiment, dealer board 202 includes processing capability for determining the value of the selected hand. A player wins if their hand has the highest determined point value and the player earns a predetermined payout. For example, the payout can be equal to the amount bet or can be greater than the amount bet, such as paying out 3 to 1 odds. In one embodiment, the payout is based on the value of the hand. In one embodiment, the predetermined payout can be based on whether a hand having interlocking game pieces or a hand having non-interlocking game pieces is selected. In one embodiment, the odds of winning the game may be made more in favor of the house. For example, a winning player will be paid less than the true odds of the bet in order to allow the house or casino to profit from hosting the game. In another embodiment, the house can take a commission on all winning players, for example, 5% of the winnings. In one embodiment, the game is played in a casino. Alternatively the game can be played on a video machine or over the Internet.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A method for playing a game comprising the steps of:

a) placing game pieces in a grid configuration, at least one of said game pieces is placed in a face-up position which reveals the value of the game piece and at least one of said game pieces is placed in a face-down position which does not reveal the value of the game piece, said grid configuration comprising a plurality of horizontal rows of said one or more game pieces;

b) one or more players each selecting a hand of a predetermined number of game pieces from the grid configuration; and c) determining a value for each of the selected hands after all of the hands are selected wherein the game pieces are one or more cards of a deck of 52 cards, the value of the hand being matched to a value of a conventional card game and wherein the one or more players play against each other or a hand of a dealer and the hand having the value which is highest is a winner.

2. The method of claim 1 wherein one or more bets are placed on the selected hand before determining the value of a plurality of said hands and a payout is paid to the winner.

3. The method of claim 2 wherein the payout is equal to an amount of the bet.

4. The method of claim 2 wherein the payout is greater than an amount of the bet.

5. The method of claim 1 wherein three game pieces are selected.

6. The method of claim 1 wherein the grid configuration is a triangular grid configuration.

7. The method of claim 6 wherein the hand is selected from one or more game pieces in which each of the game pieces is adjacent to another game piece or in a corner of said triangular grid configuration.

8. The method of claim 1 wherein the grid configuration is a square configuration.

9. The method of claim 8 wherein said square configuration is formed of three game pieces in each horizontal row and three game pieces in each vertical row.

10. The method of claim 9 wherein said hand is selected from three game pieces in a row along a diagonal row, vertical row or horizontal row of the square grid configuration.

11. The method of claim 1 wherein the grid configuration is an outer square configuration.

12. The method of claim 1 wherein the grid configuration is a hexagonal grid configuration.

13. The method of claim 1 wherein the grid configuration is a right angle triangular configuration.

14. The method of claim 1 wherein the grid configuration is a diamond grid configuration.

15. The method of claim 1 wherein the grid configuration is a stacked grid configuration.

16. The method of claim 1 wherein the game pieces are placed in an initial grid configuration and further comprising the step of:

after one of the hands is selected, adding an additional game piece to the initial grid configuration.

17. The method of claim 16 wherein a player is selected to add said additional game piece to said initial configuration.

18. The method of claim 17 wherein a hand is selected from game pieces positioned in a vertical row of said rectangular grid configuration.

19. The method of claim 18 wherein the hand comprises three game pieces in said vertical row.

20. The method of claim 1 wherein said grid configuration is a rectangular grid configuration.

21. The method of claim 1 wherein in step a), game pieces are placed in a plurality of rectangular grid configurations, a hand of five game pieces is selected from a horizontal row of one of said rectangular grid configurations;

a hand of two game pieces is selected from a vertical row of said one of said rectangular grid configurations.

22. The method of claim 1 wherein the game is played in a casino.

23. The method of claim 1 further comprising the step of operating the game on a video machine, wherein each of said selected hands is displayed on a video display.

24. The method of claim 1 further comprising operation the game through a data network.

25. The method of claim 24 wherein the data network is the Internet.

* * * * *